US011165129B2

(12) United States Patent
Dogiamis et al.

(10) Patent No.: US 11,165,129 B2
(45) Date of Patent: Nov. 2, 2021

(54) DISPERSION REDUCED DIELECTRIC WAVEGUIDE COMPRISING DIELECTRIC MATERIALS HAVING RESPECTIVE DISPERSION RESPONSES

(71) Applicant: Intel Corporation, Santa Clara, CA (US)

(72) Inventors: Georgios Dogiamis, Chandler, AZ (US); Sasha Oster, Chandler, AZ (US); Telesphor Kamgaing, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/463,329

(22) PCT Filed: Dec. 30, 2016

(86) PCT No.: PCT/US2016/069540
§ 371 (c)(1),
(2) Date: May 22, 2019

(87) PCT Pub. No.: WO2018/125227
PCT Pub. Date: Jul. 5, 2018

(65) Prior Publication Data

US 2019/0379097 A1 Dec. 12, 2019

(51) Int. Cl.
*H01P 3/16* (2006.01)
*H01P 3/12* (2006.01)
(Continued)

(52) U.S. Cl.
CPC ..... *H01P 3/165* (2013.01); *H01P 3/122* (2013.01); *H01P 3/16* (2013.01); *H01P 11/006* (2013.01); *H01P 5/087* (2013.01)

(58) Field of Classification Search
CPC ..... H01P 3/16; H01P 11/006; H01P 3/122; H01P 3/165
(Continued)

(56) References Cited

U.S. PATENT DOCUMENTS 3,268,902 A * 8/1966 Turrin ..... H01P 1/16 343/772
4,463,330 A * 7/1984 Yoneyama ..... H01P 3/165 333/239
(Continued)

OTHER PUBLICATIONS

International Search Report and Written Opinion for International Patent Application No. PCT/US2016/069540 dated Sep. 27, 2017, 12 pgs.
(Continued)

*Primary Examiner* — Benny T Lee
(74) *Attorney, Agent, or Firm* — Schwabe, Williamson & Wyatt, P.C.

(57) ABSTRACT

Embodiments of the invention include a dispersion reduced dielectric waveguide and methods of forming such devices. In an embodiment, the dispersion reduced dielectric waveguide may include a first dielectric material that has a first Dk-value, and a second dielectric material that has a second Dk-value that is greater than the first Dk-value. In an embodiment, the dispersion reduced dielectric waveguide may also include a conductive layer formed around the first and second dielectric materials. According to an embodiment, a first portion of a bandwidth of a signal that is propagated along the dispersion reduced dielectric waveguide is primarily propagated along the first dielectric material, and a second portion of a bandwidth of the signal that is propagated along the dispersion reduced dielectric waveguide is primarily propagated along the second dielectric material.

12 Claims, 7 Drawing Sheets

(51) Int. Cl.
*H01P 11/00* (2006.01)
*H01P 5/08* (2006.01)

(58) Field of Classification Search
USPC ..... 333/239
See application file for complete search history.

(56) References Cited

U.S. PATENT DOCUMENTS

| | | | | |
|---|---|---|---|---|
| 5,986,527 | A * | 11/1999 | Ishikawa et al. | H01P 3/16 333/239 |
| 6,104,264 | A * | 8/2000 | Ishikawa et al. | H01P 3/165 333/239 |
| 2002/0027481 | A1* | 3/2002 | Fiedziuszko | H01P 5/18 333/116 |
| 2002/0126713 | A1 | 9/2002 | Ibanescu et al. | |
| 2009/0017255 | A1* | 1/2009 | Maruyama et al. | H01P 3/165 428/120 |
| 2010/0156573 | A1 | 6/2010 | Smith et al. | |
| 2014/0368301 | A1* | 12/2014 | Herbsommer et al. | H01P 3/16 333/239 |
| 2015/0295297 | A1* | 10/2015 | Cook et al. | H01P 11/001 333/239 |
| 2015/0295299 | A1 | 10/2015 | Herbsommer | |
| 2016/0116672 | A1 | 4/2016 | Leobandung | |
| 2016/0336638 | A1 | 11/2016 | Dang et al. | |

OTHER PUBLICATIONS

International Preliminary Report on Patentability for International Patent Application No. PCT/US2016/069540 dated Jul. 11, 2019, 9 pgs.

* cited by examiner

DISPERSION REDUCED DIELECTRIC WAVEGUIDE COMPRISING DIELECTRIC MATERIALS HAVING RESPECTIVE DISPERSION RESPONSES

CROSS-REFERENCE TO RELATED APPLICATION

This patent application is a U.S. National Phase Application under 35 U.S.C. § 371 of International Application No. PCT/US2016/069540, filed Dec. 30, 2016, entitled "WAVEGUIDE DESIGN TECHNIQUES TO ENHANCE CHANNEL CHARACTERISTICS," which designates the United States of America, the entire disclosure of which is hereby incorporated by reference in its entirety and for all purposes.

FIELD OF THE INVENTION

Embodiments of the invention are in the field of semiconductor packaging and, in particular, formation of mm-wave cables with improved dispersion characteristics.

BACKGROUND OF THE INVENTION

As more devices become interconnected and users consume more data, the demand on improving the performance of servers has grown at an incredible rate. One particular area where server performance may be increased is the performance of interconnects between components, because there are so many interconnects within server and high performance computing (HPC) architectures today. These interconnects include within blade interconnects, within rack interconnects, and rack-to-rack interconnects or rack-to-switch interconnects. In order to provide the desired performance, these interconnects may need to have increased data rates and switching architectures which require longer interconnects. Furthermore, due to the large number of interconnects, the cost of the interconnects and the power consumption of the interconnects should both be minimized. In current server architectures, short interconnects (e.g., within rack interconnects and some rack-to-rack interconnects) are achieved with electrical cables, such as Ethernet cables, co-axial cables, or twin-axial cables, depending on the required data rate. For longer distances (e.g., greater than five meters), optical solutions are employed due to the long reach and high bandwidth enabled by fiber optic solutions. Optical interconnects may utilizes optical interconnect technology and various semiconductor technologies along with optical fibers.

However, as new architectures emerge, such as 100 Gigabit Ethernet, traditional electrical connections are becoming increasingly expensive and power intensive to support the required data rates for short (e.g. 2 meters to 5 meters) interconnects. For example, to extend the length of a cable or the given bandwidth on a cable, higher quality cables may need to be used or advanced equalization, modulation, and/or error correction techniques employed. Accordingly, these solutions require additional power and increase the latency to the system. Optical transmission over fiber is capable of supporting the required data rates and distances, but at a severe power and cost penalty, especially for short to medium distances (e.g., a few meters). For some distances and data rates required in proposed architectures, there is no viable electrical solution today. For medium distance communication in a server farm, the overhead power associated with the optical fiber interconnects is too high, whereas the required error correction on traditional electrical fabric creates a substantial latency (e.g., several hundred nanoseconds). This makes both technologies (traditional electrical and optical) not particularly optimal for emerging rack-scale architecture (RSA) servers including HPCs, where most transmission range are between 2 and 5 meters.

One proposed interconnect technology that may provide high data rates with lower power consumption is millimeter (mm)-wave waveguide interconnect technology. Millimeter (mm)-wave waveguides propagate mm-wave signals along a dielectric waveguide. Typically, the dielectric waveguide is also covered by a metallic layer to provide electrical shielding to prevent cross-talk or other interference. Dielectric waveguides are beneficial because they provide low signal attenuation compared to traditional electrical interconnects used in high-speed I/O technologies. However, the propagation of mm-waves along a shielded dielectric waveguide may be dispersion limited and depends on the specific waveguide architecture. The dielectric waveguide may be loss-limited if the incurred dispersion over the length of the channel is not significant (typically in pure dielectric waveguides), or may be dispersion limited if the length of the channel is significant (typically in metal air core waveguides). Dispersion describes the phenomenon that not all frequencies have the same velocity as they are propagated through the dielectric material of the dielectric waveguide. Accordingly, in longer mm-wave waveguides the signal may incur excessive dispersion and spread too much, therefore, becoming difficult to decode at the receiving end.

DETAILED DESCRIPTION OF THE INVENTION

Described herein are systems that include dielectric waveguides with improved dispersion characteristics, which are also referred to herein as a "dispersion reduced dielectric waveguide". In the following description, various aspects of the illustrative implementations will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative implementations. However, it will be apparent to one skilled in the art that the present invention may be practiced without the specific details. In other instances, well-known features are omitted or simplified in order not to obscure the illustrative implementations.

Various operations will be described as multiple discrete operations, in turn, in a manner that is most helpful in understanding the present invention. However, the order of description should not be construed to imply that these operations are necessarily order dependent. In particular, these operations need not be performed in the order of presentation.

As noted above, dielectric waveguides with a conductive coating are dispersion limited. Particularly, different frequencies of a signal spectrum will not propagate along the conductive-coated dielectric waveguides at the same speed. This results in signal spreading as it is propagated along the dielectric waveguide. Signal spreading limits the maximum achievable interconnect length (channel length) or may limit the maximum transmittable bandwidth of the signal. In other words, signal spreading may limit the maximum data rate that may be transmitted along the dielectric waveguide.

Figure 1A:
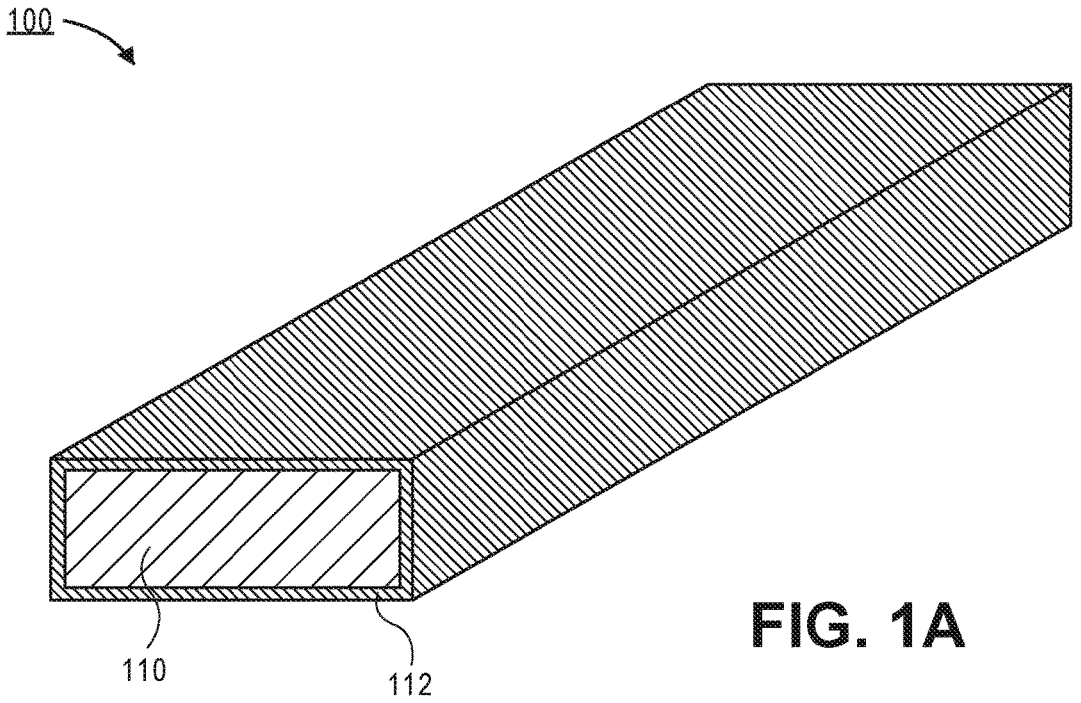
FIG. 1A is a perspective illustration of a portion of a dielectric waveguide with a conductive coating.

Referring now to FIG. 1A, a perspective view of a standard dielectric waveguide 100 is shown. Typically, the dielectric waveguide 100 includes a dielectric core 110 that is shielded by a conductive (e.g. metallic) layer 112. The dimensions of the dielectric core 110 are chosen in order to propagate desired wavelengths. For example, mm-wave signals may be propagated along a dielectric waveguide that has a width of approximately 1.0 mm and a height of approximately 0.5 mm. However, it is to be appreciated that for the same dielectric materials, in general, relatively larger cross-sections support lower frequencies whereas relatively smaller cross-sections support higher frequencies, and embodiments of the invention are not limited to any particular cross-sectional dimensions.

Figure 1B:
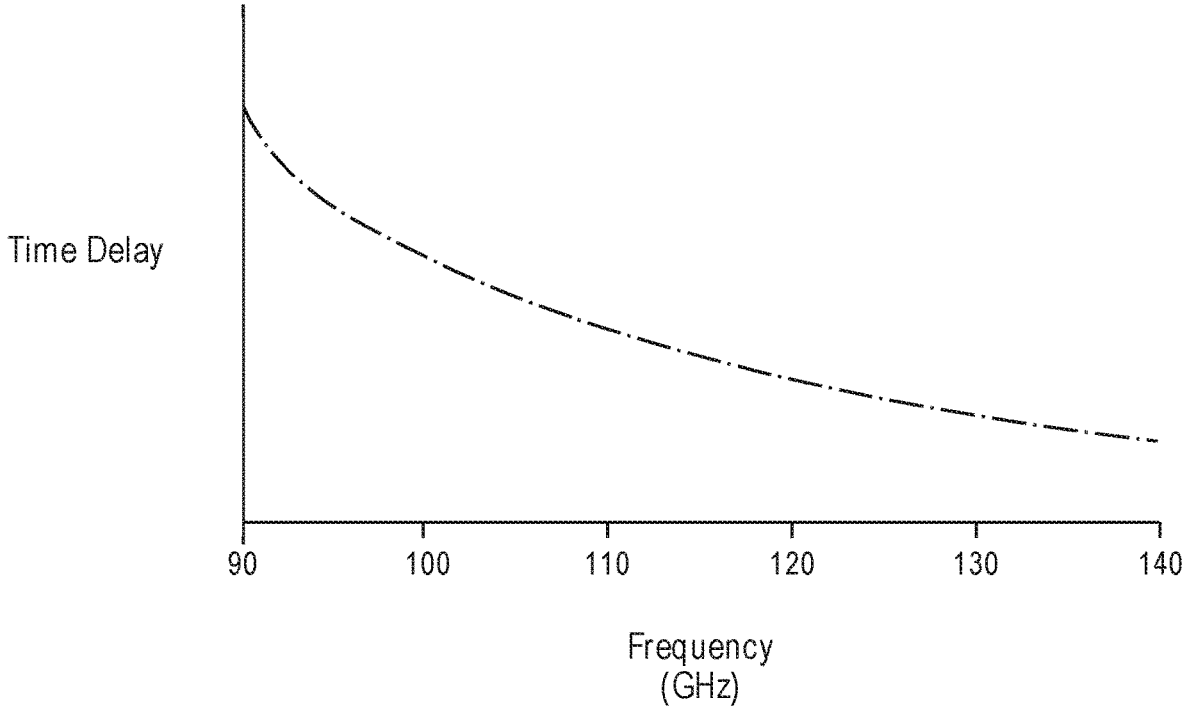
FIG. 1B is a graph plotting the time delay per meter for different frequency signals in a dielectric waveguide.

Referring now to FIG. 1B, a graph of the dispersion characteristics of a typical dielectric waveguide in the 90 GHz to 140 GHz frequency bandwidth is shown, with time delay (ns/m) on the Y-axis and Frequency (GHz) on the X-axis, according to an embodiment of the invention. In the illustrated bandwidth there is a significant decrease in the time delay of the higher frequencies. For example, there may be approximately a 2.5 ns/m difference in the time delay between the 90 GHz frequency component and the 140 GHz frequency component. In order to provide a signal that does not require extensive processing to correct for the dispersion, the useable bandwidth is limited to the region of the bandwidth where the dispersion characteristic is substantially flat. However, reducing the bandwidth causes the reduction of the maximum achievable data rate. Accordingly, embodiments of the invention include dispersion reduced dielectric waveguides that are designed to adjust the difference in the time delay between the lower frequencies and the higher frequencies of a chosen bandwidth.

Figure 2A:
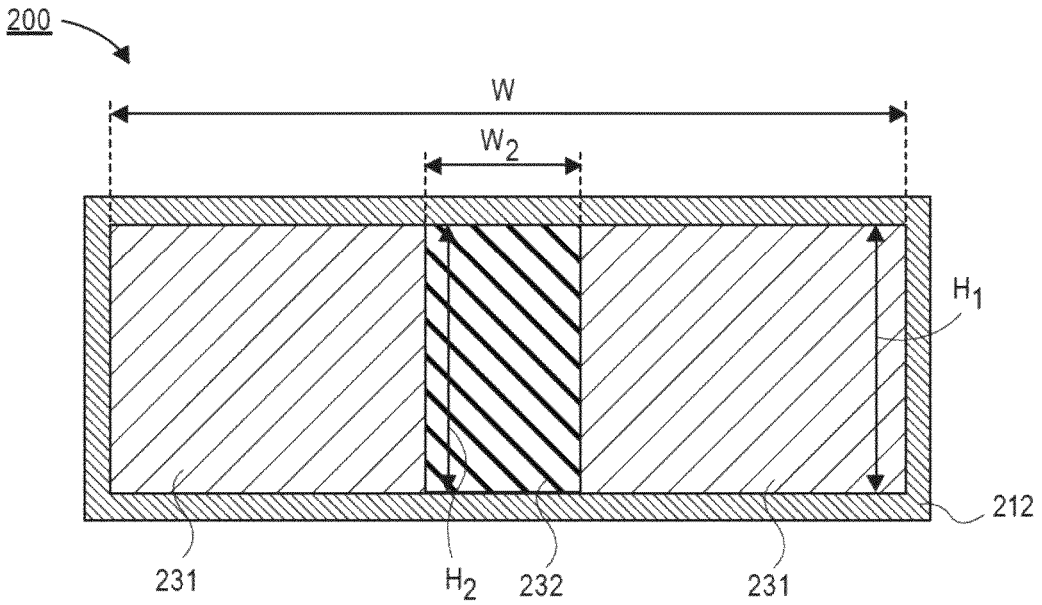
FIG. 2A is a cross-sectional illustration of a dielectric waveguide formed with dielectric materials with different Dk-values, according to an embodiment of the invention.

Referring now to FIG. 2A, a cross-sectional illustration of a dispersion reduced dielectric waveguide 200 is shown according to an embodiment of the invention. In an embodiment, the dispersion reduced dielectric waveguide 200 reduces the difference of the time delay between the high frequencies and the low frequencies of the bandwidth by including two or more different dielectric materials that have different dielectric constant (Dk) values. For example, the dispersion reduced dielectric waveguide 200 includes a first dielectric material 231 and a second dielectric material 232. This is beneficial for reducing the dispersion over a given bandwidth because different frequencies will preferentially propagate along different materials. In general, higher frequencies will preferentially propagate along the higher Dk-value dielectric material, whereas lower frequencies will preferentially propagate along the lower Dk-value dielectric material. The propagation along the lower Dk-value dielectric material reduces the time delay of these relatively lower frequencies, and results in an overall reduction of the dispersion. By reducing the dispersion over a given bandwidth, a dielectric waveguide of a given length may provide a reliable signal with a larger bandwidth or a dielectric waveguide for propagating a given bandwidth may provide a reliable signal over a longer interconnect distance.

In an embodiment, the second dielectric material 232 may be sandwiched between the first dielectric material 231. As such, the height H2 of the second dielectric material 232 may be substantially similar to the height H1 of the first dielectric material. In an embodiment a width W2 of the second dielectric material 232 may be less than a width W of the dispersion reduced dielectric waveguide 200. In an embodiment, the width W2 may be approximately 50% or less than the width W of the dispersion reduced dielectric waveguide 200. In an additional embodiment, the width W2 may be approximately 25% or less than the width of the dispersion reduced dielectric waveguide 200.

According to an embodiment, the dispersion reduced dielectric waveguide 200 includes a first dielectric material 231 that has a Dk-value that is less than the Dk-value of the second dielectric material 232. In an embodiment, the Dk-values of first and second dielectric materials may be between approximately 1.7 and 3.0. The different Dk-values may be obtained by utilizing different materials for the first dielectric material 231 and the second dielectric material 232. For example, the first or second dielectric materials 231, 232 may include liquid crystal polymer (LCP), low-temperature co-fired ceramic (LTCC), glass, polytetrafluoroethylene (PTFE), expanded PTFE, low-density PTFE, ethylene tetrafluoroethylene (ETFE), fluorinated ethylene propylene (FEP), polyether ether ketone (PEEK), or perfluoroalkoxy alkanes (PFA).

Embodiments of the invention may form the dispersion reduced dielectric waveguide 200 with any suitable process. For example, the first and second dielectric layers 231, 232 may be formed with an extrusion process (e.g., melt extrusion or paste extrusion), lamination, chemical vapor deposition (CVD), or the like. After the dielectric materials are formed, embodiments may include forming a conductive layer 212 over the exposed surfaces of the first and second dielectric layers 231, 232 to provide shielding.

Figure 2B:
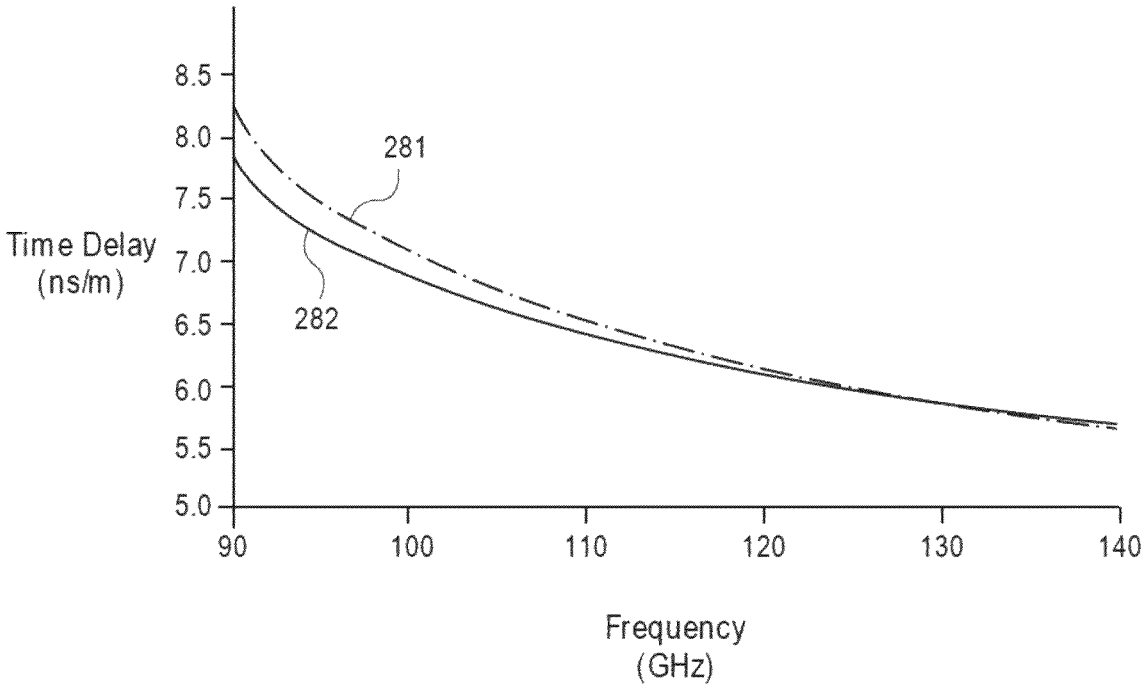
FIG. 2B is a graph plotting the time delay per meter for different frequency signals in a dielectric waveguide and a dielectric waveguide formed with more than one dielectric material that have different Dk-values, according to an embodiment of the invention.

An example of such improvement in performance is provided in the graph illustrated in FIG. 2B, where the Y-axis is a Time Delay (ns/m) and the X-axis is a Frequency (GHz). The dashed line 281 is a representation of the dispersion characteristics of a dielectric waveguide 100 without dispersion reduction and the solid line 282 is a representation of the dispersion characteristics of a dispersion reduced dielectric wave guide 200. As shown, the inclusion of a second dielectric material that has a different Dk-value than the first dielectric material significantly reduces the time delay of the lower frequencies in the given bandwidth. For example, the illustrated embodiment provides a time delay improvement in the dispersion reduced dielectric waveguide 200 of approximately 1.0 ns/m for the lowest frequency shown (i.e., 90 GHz) compared to the dielectric waveguide without dispersion reduction.

Figure 3A:
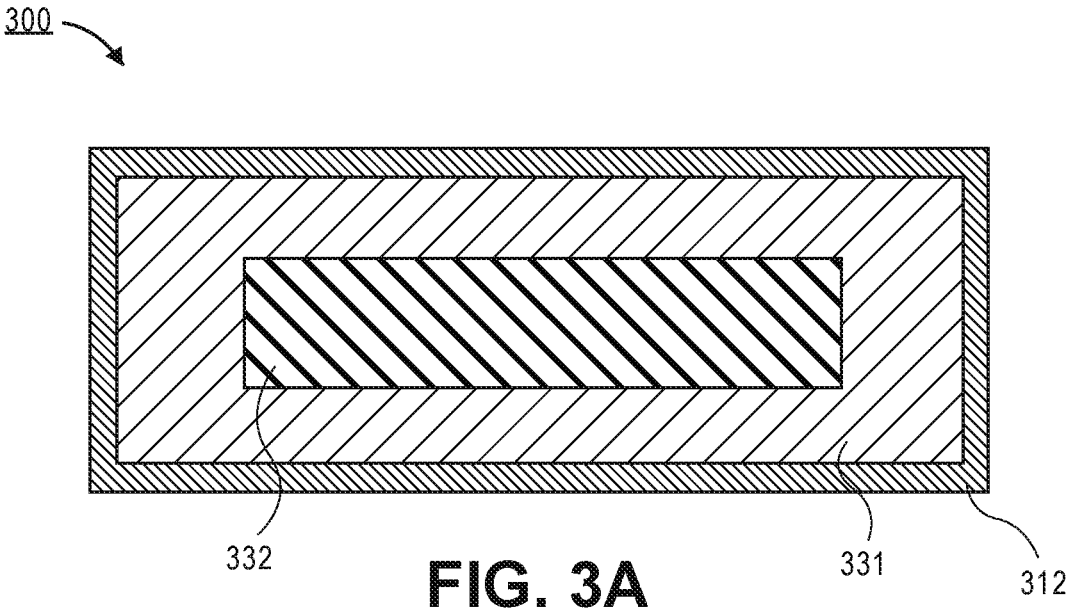
FIG. 3A is a cross-sectional illustration of a dielectric waveguide formed with a core that has a first dielectric material and second dielectric material around the core, according to an embodiment of the invention.

While FIG. 2A provides an exemplary illustration of one possible cross-section of a dispersion reduced dielectric waveguide, embodiments are not limited to such configuration. For example, embodiments of the invention may include any dielectric waveguide that includes two or more dielectric materials with different Dk-values. For example, FIG. 3A is a cross-sectional illustration of a dispersion reduced dielectric waveguide 300 according to an additional embodiment of the invention. The dielectric waveguide 300 may include a first dielectric material 331 and a second dielectric material 332 within a conductive layer 312. In an embodiment, the second dielectric material 332 may be a material that has a Dk-value that is greater than a Dk-value of a material chosen for the first dielectric material 331 in order to provide preferential propagation pathways for different frequencies. In an embodiment, the second dielectric material 332 may be completely surrounded by the first dielectric material 331. In the illustrated embodiment, the second dielectric material 332 is substantially centered with the first dielectric material 331. However, embodiments are not limited to such configurations. For example, the second dielectric material 332 may be off-center from the first dielectric material 331. Additionally, in the illustrated embodiment, the shape of the perimeter of the second dielectric material 332 is substantially similar to the shape of the perimeter of the first dielectric material 331. However, additional embodiments are not limited to such configurations. For example, the perimeter of the first dielectric material 331 may be substantially rectangular and the perimeter of the second dielectric material 332 may be substantially square with or without chamfered corners. Similar to the dispersion reduced waveguide 200 described above, a conductive layer 312 may be formed around the exposed surfaces of the dielectric materials. Particularly, since the second dielectric material 332 is completely surrounded by the first dielectric material 331, the conductive layer 312 may only contact the first dielectric material in some embodiments.

Embodiments of the invention where the second dielectric material 332 is completely surrounded by the first dielectric material 331 may be formed with similar materials and methods used to form the dispersion reduced dielectric waveguide 200 described above. For example, the first and second dielectric materials 331, 332 may include dielectric materials with Dk-values between approximately 1.7 and 3.0, such as LCP, PTFE, expanded PTFE, low-density PTFE, ETFE, FEP, PEEK, or PFA. Additionally, dispersion reduced dielectric wave guide 300 may be formed with extrusion processes, according to an embodiment of the invention.

Figure 3B:
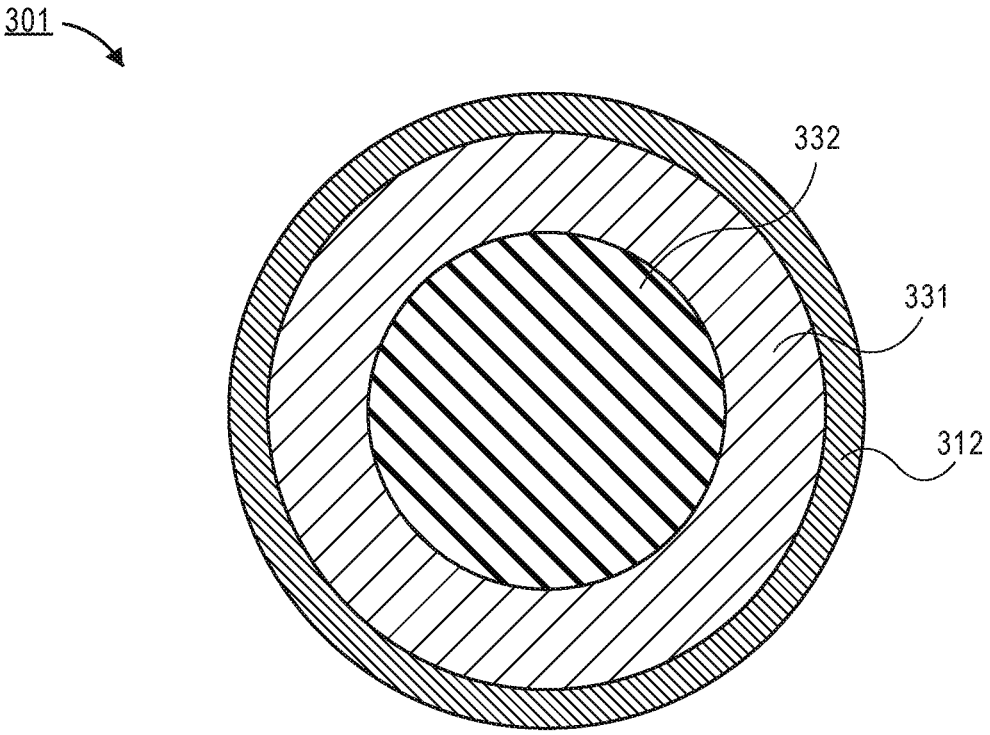
FIG. 3B is a cross-sectional illustration of a dielectric waveguide with a circular cross-section that is formed with a core that has a first dielectric material and second dielectric material around the core, according to an embodiment of the invention.

In addition to substantially rectangular cross-sections, embodiments of the invention may also include dispersion reduced dielectric waveguides that do not have substantially rectangular cross-sections. For example, FIG. 3B is a cross-sectional illustration of a dispersion reduced dielectric waveguide 301 that includes first and second dielectric materials 331, 332 that have substantially circular cross-sections within a conductive layer 312, according to an embodiment of the invention. Aside from the shapes of the cross-sections of the first and second dielectric materials 331, 332, the dispersion reduced dielectric waveguide 301 may be substantially similar to the dispersion reduced dielectric waveguide 300 described with respect to FIG. 3A. Furthermore, it is to be appreciated that dielectric materials within a dispersion reduced dielectric waveguide may also include both polygon shaped cross-sections and non-polygon shaped cross-sections. For example, the first dielectric material 331 may have a substantially rectangular shaped perimeter and the second dielectric material 332 may have a substantially circular or elliptical shaped perimeter.

Up until this point, embodiments of the invention have described dispersion reduced dielectric waveguides that include a first dielectric material and a second dielectric material. While dielectric waveguides with at least two different dielectric materials provide an improvement over the typical dielectric waveguide, embodiments of the invention may also include more than two different dielectric materials. In such embodiments, a plurality of dielectric materials with different Dk-values may form a dispersion reduced dielectric waveguide that includes a cross-section with a graded Dk-value.

Figure 4A:
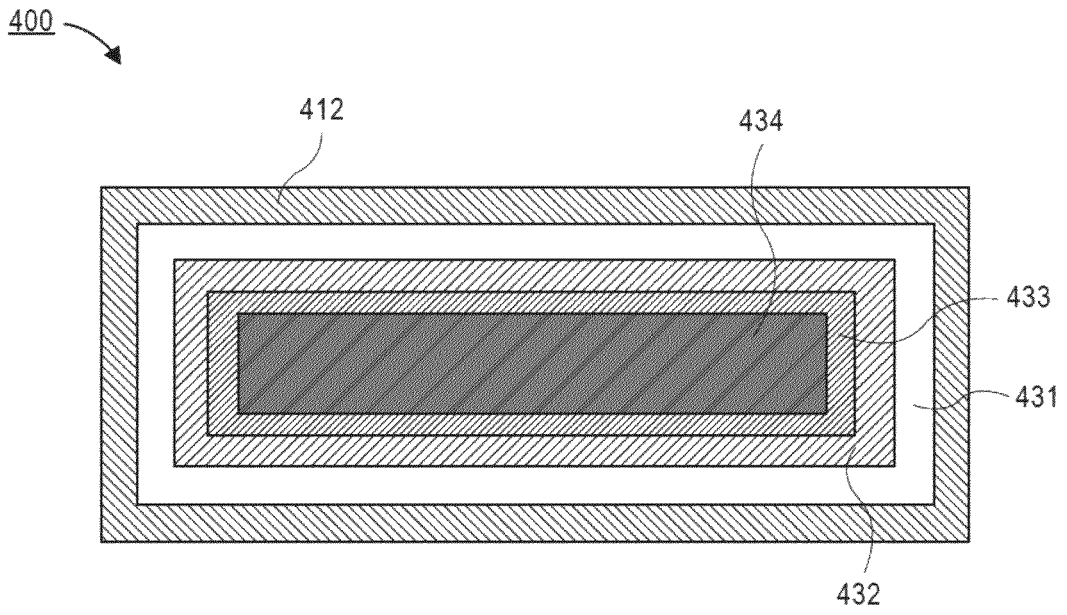
FIG. 4A is a cross-sectional illustration of a dielectric waveguide that has a plurality of substantially concentric dielectric layers that form a graded Dk-value core, according to an embodiment of the invention.

An example of a dispersion reduced dielectric waveguide 400 with a plurality of dielectric materials is shown in the cross-sectional illustration shown in FIG. 4A. In the illustrated embodiment, the dispersion reduced dielectric waveguide 400 includes a first dielectric material 431, a second dielectric material 432, a third dielectric material 433, and a fourth dielectric material 434 within a conductive layer 412. Additional embodiments may include fewer than four dielectric layers or more than four dielectric layers. In an embodiment, each dielectric layer may have a different Dk-value with the first dielectric 431 having the lowest Dk-value and each subsequent dielectric layer having a progressively higher Dk-value. For example, the fourth dielectric layer 434 may have the highest Dk-value, the third dielectric layer 434 may have the second highest Dk-value, the second dielectric layer 432 may have the third highest Dk-value, and the first dielectric layer 431 may have the lowest Dk-value. According to an embodiment, the Dk-values of each subsequent dielectric layer may increase linearly. Additional embodiments may include Dk-values of each subsequent dielectric layer that increase non-linearly.

In an embodiment, the plurality of dielectric layers 431-434 may be substantially concentric with each other (i.e., the center point of each dielectric layer 431-434 may be the same). However, additional embodiments of the invention may not include substantially concentric dielectric layers. Furthermore, the shape of the perimeter of each dielectric layer 431-434 may be substantially similar to each other. Alternatively, embodiments may include a dispersion reduced dielectric waveguide where one or more of the dielectric layers 431-434 do not have perimeters that are substantially similar to each other. For example, on or more of the dielectric layers may have a perimeter that is substantially rectangular shaped while the remaining dielectric layers have a perimeter that is substantially square shaped.

According to an embodiment, the cross-sectional area of each dielectric layer 431-434 may be substantially similar. Additional embodiments may include dielectric layers 431-434 that do not have a substantially similar cross-sectional area. For example, the first dielectric layer 434 may have a cross-sectional area that is greater than or less than a cross-sectional area of the fourth dielectric layer 434. In some embodiments the cross-sectional area of each of the dielectric layers 431-434 are different. In yet another embodiment, two or more of the dielectric layers 431-434 may have the same cross-sectional area.

Figure 4B:
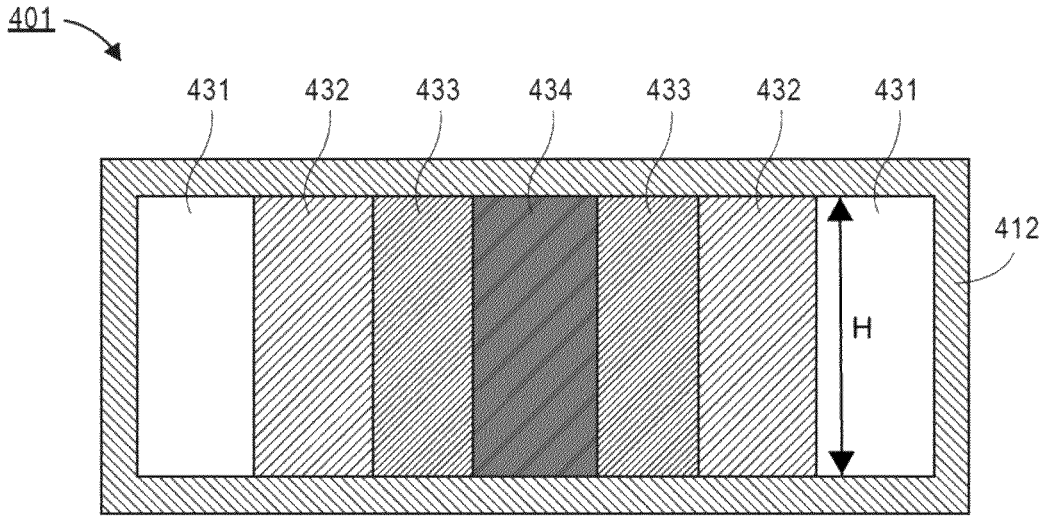
FIG. 4B is a cross-sectional illustration of a dielectric waveguide that has a plurality of dielectric layers that form a graded Dk-value core, according to an embodiment of the invention.

In an additional embodiment, a dispersion reduced dielectric waveguide may also include a plurality of dielectric layers that form a graded Dk-value that extends in a single direction. FIG. 4B provides a cross-sectional illustration of such an embodiment. In FIG. 4B, each dielectric layer 431, 431, 433, and 434 within the conductive layer 412 of dielectric waveguide 401 has approximately the same height H. Accordingly, the dielectric layers 431, 431, 433, and 434 form a Dk-value gradient that changes in the horizontal direction of FIG. 4B, with the innermost dielectric layer 434 having the highest Dk-value and the outermost dielectric layer 431 having the lowest Dk-value.

Embodiments of the invention that include a plurality of dielectric layers, such as those described in FIGS. 4A and 4B may be formed with similar materials and methods used to form the dispersion reduced dielectric waveguide 200 described above with respect to FIG. 2A. For example, the dielectric materials may include dielectric materials with Dk-values between approximately 1.7 and 3.0, such as PTFE, expanded PTFE, low-density PTFE, ETFE, FEP, PEEK, or PFA. Additionally, dispersion reduced dielectric wave guide 300 may be formed with extrusion processes or lamination processes, according to an embodiment of the invention.

Figure 5A:
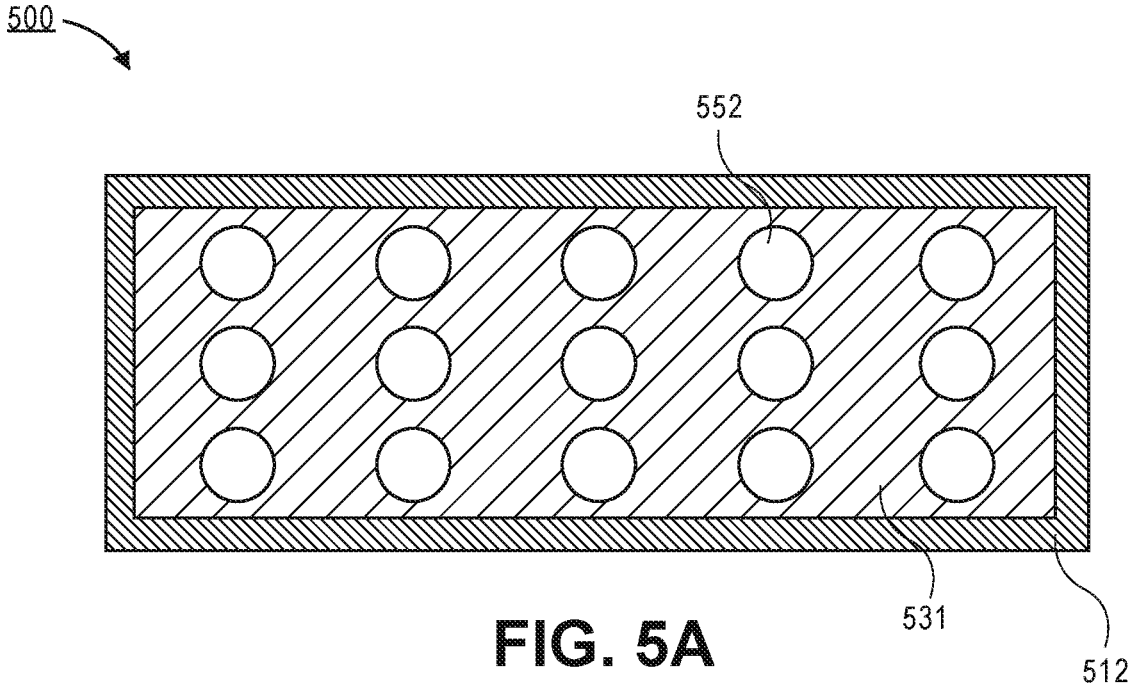
FIG. 5A is a cross-sectional illustration of a dielectric waveguide with a first dielectric material and a plurality of dielectric cores of a second dielectric material running through the dielectric waveguide, according to an embodiment of the invention.

In yet another embodiment of the invention, a dispersion reduced dielectric waveguide may include a first dielectric layer with a plurality of dielectric cores distributed over the cross-sectional area. Examples of such an embodiment are illustrated with respect to FIGS. 5A and 5B. Referring now to FIG. 5A, a cross-sectional illustration of a dispersion reduced dielectric waveguide 500 is shown with a plurality of dielectric cores 552 distributed across the cross-section of the first dielectric material 531 within a conductive layer 512. In an embodiment, the dielectric cores 552 may be any shape. For example, the illustrated embodiment includes circular shaped cores 552. However, additional embodiments may include polygon shaped cores 552, elliptical shaped cores, or the like. In an embodiment, each of the dielectric cores 552 may be substantially the same size and shape. Additional embodiments may include dielectric cores 552 that are formed with different shapes and/or different sizes.

According to an embodiment, the plurality of dielectric cores 552 may all be the same dielectric material. In an additional embodiment, the dielectric cores 552 may include two or more different dielectric materials. In yet another embodiment, the dielectric cores 552 may be replaced with air cores (i.e., the first dielectric material 531 may include a plurality of air gaps.

Figure 5B:
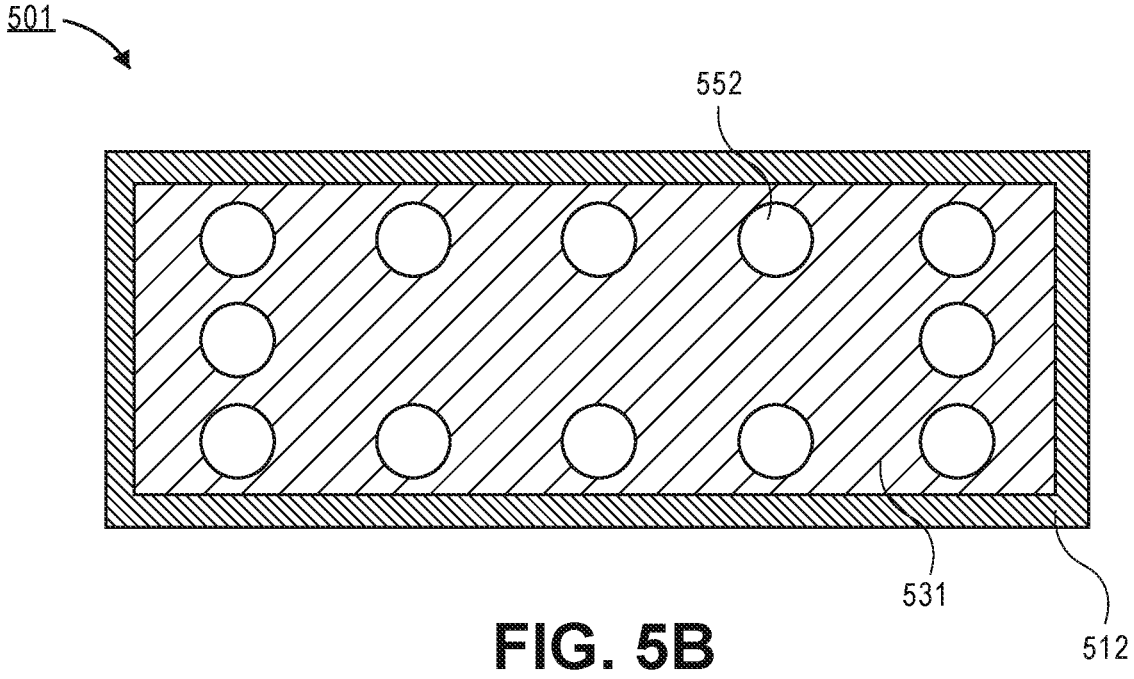
FIG. 5B is a cross-sectional illustration of a dielectric waveguide with a first dielectric material and a plurality of dielectric cores of a second dielectric material running through the dielectric waveguide near the edges of the first dielectric material, according to an embodiment of the invention.

In FIG. 5A, the dielectric cores 552 are illustrated as being substantially evenly spaced across the cross-section of the first dielectric material 531. However, embodiments are not limited to such configurations. For example, the dielectric cores 552 may be positioned around the outer edges of the first dielectric material 531 within a conductive layer 512, as shown in FIG. 5B. In such an embodiment, the dielectric cores 552 may substantially confine a signal propagated along the dispersion reduced dielectric waveguide 501 to a center portion of the first dielectric material 531.

While embodiments of the invention may provide dispersion reduction by utilizing different dielectric materials with different Dk-values, it is also possible to provide dispersion reduction by utilizing dispersion compensating materials. As used herein, a dispersion compensating material may be a material that is engineered to provide a dispersion response that is substantially opposite to the dispersion response present in a dielectric waveguide. In an embodiment, a dispersion compensating material may be a metamaterial. Metamaterials are engineered materials that exhibit properties not usually found in natural materials. In a particular embodiment, metamaterials used according to embodiments of the invention may include Dk-values that are not otherwise obtainable in naturally occurring materials. For example, metamaterials may exhibit a negative Dk-value. A negative Dk-value material may provide a dispersion response for a signal with a given bandwidth that is substantially opposite to the dispersion response produced by the dielectric waveguide. Accordingly, as the signal propagates along the dispersion reduced dielectric waveguide, the effects of the dispersion responses of the dielectric material and the dispersion compensating material substantially cancel, and the signal remains substantially unaltered.

Dispersion compensating materials may be any suitable material or composite material that has been developed to counteract the dispersion response produced by a dielectric material. In some embodiments, the dispersion compensating material may include patterned structures that interact with the signal. For example, the patterned structures may be smaller than the wavelength of the propagated signal. According to an embodiment, the dispersion compensating material may include any patterned structures that provides the desired dispersion response. In one embodiment the patterned structures may include repeating patterns of rods or wires sized to interact with the propagated signal. Additional embodiments may include patterned structures that form sub-wavelength resonators, such as omega cells or split-ring resonators.

Figure 6A:
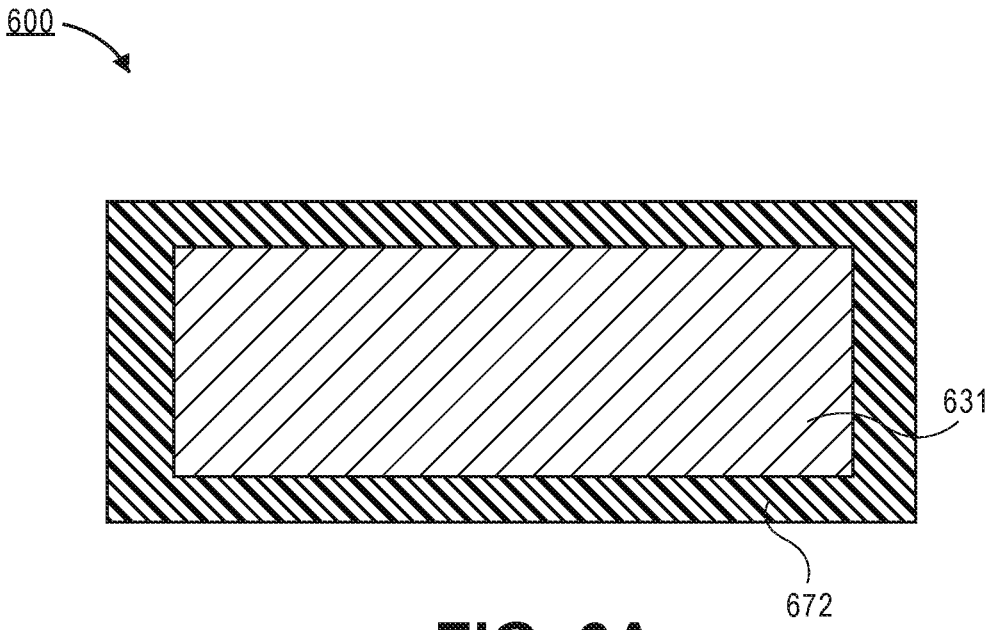
FIG. 6A is a cross-sectional illustration of a dielectric waveguide with a metamaterial layer formed over the surfaces of the dielectric core, according to an embodiment of the invention.
Figure 6B:
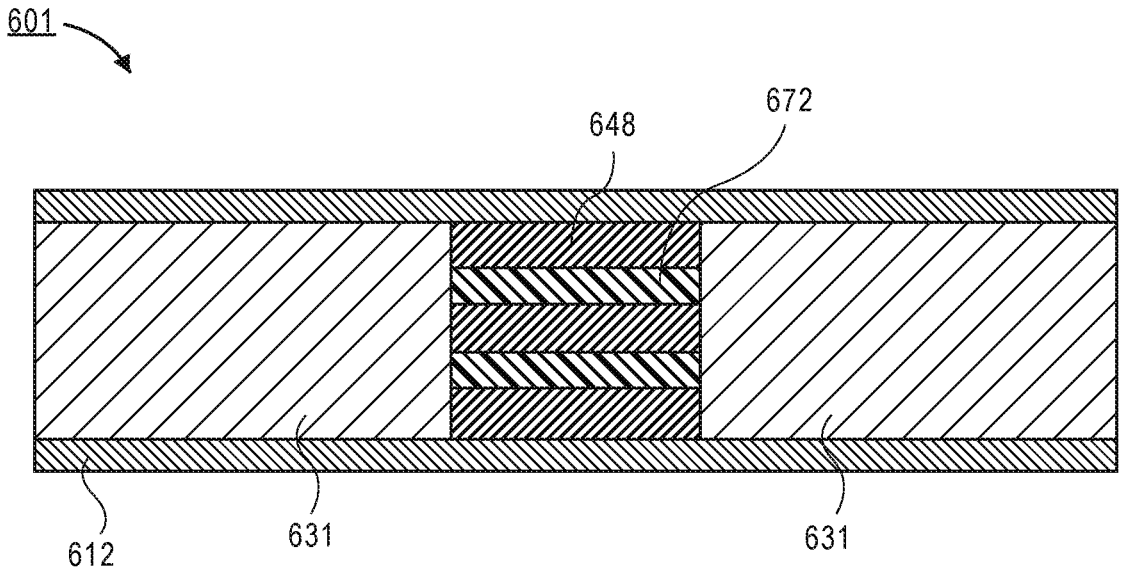
FIG. 6B is a cross-sectional illustration along the length of the dielectric waveguide with a dispersion correction portion, according to an embodiment of the invention.

Referring now to FIGS. 6A and 6B, cross-sectional illustrations of dispersion reduced dielectric waveguides that utilize dispersion compensating materials are shown, according to an embodiment of the invention. In FIG. 6A a dispersion reduced dielectric waveguide 600 that includes a dispersion compensating material 672 formed around the perimeter of a dielectric material 631 is shown, according to an embodiment of the invention. In an embodiment, the dispersion compensating material 672 may be formed completely around the dielectric material 631. Additional embodiments may include a dispersion compensating material 672 that is formed partially around the dielectric material 631.

Embodiments of the invention may include forming the dielectric material 631 with an extrusion process. Thereafter, the dispersion compensating material 672 may be formed around the dielectric material 631. For example, the dispersion compensating material 672 may be wrapped around the dielectric material and then crimped down to secure the dispersion compensating material 672 to the dielectric material 631. In an additional embodiment, the dispersion compensating material 672 may be wrapped around the dielectric material 631 and covered with an overmolding material. In an additional embodiment, the dispersion compensating material 672 may be selectively patterned on the dielectric material 631.

In FIG. 6A, the dispersion compensating material 672 extends along the entire length of the dispersion reduced dielectric waveguide 600. However, is some embodiments, the dispersion compensating material 672 may be formed at one or more locations along the length of the dielectric waveguide. Such an embodiment is illustrated in FIG. 6B. FIG. 6B is cross-sectional illustration along the length of a dispersion reduced dielectric waveguide 601, according to an embodiment of the invention. As illustrated, the dispersion compensating material 672 may be formed between adjacent portions of the dielectric material 631 and within the conductive layer 612. As such, the signal may pass through the dielectric material 631 and become dispersed. Upon passing through the section including the dispersion compensating material 672, the dispersion may be substantially reversed by the dispersion compensating material 672 and the signal is restored to its original form. In an additional embodiment, the dispersion compensating material 672 may partially compensate for a portion of the dispersion. In such embodiments the dispersion may be reduced, but not completely eliminated. In an embodiment, the dispersion compensating material may be embedded within a dielectric medium 648. The dielectric medium 648 may be the same material as the dielectric material 641 or it may be a different dielectric material.

Figure 7:
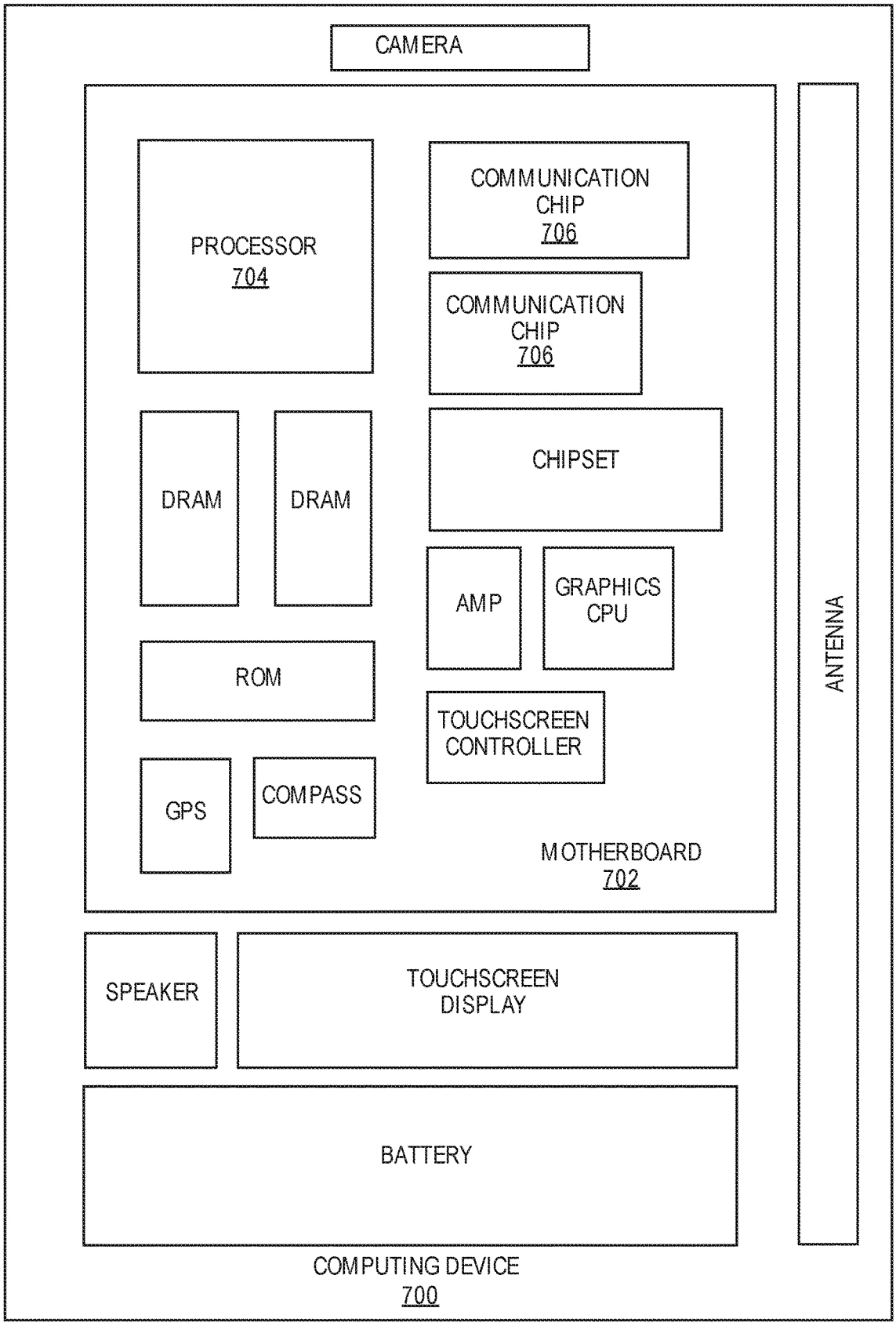
FIG. 7 is a schematic of a computing device built in accordance with an embodiment of the invention.

FIG. 7 illustrates a computing device 700 in accordance with one implementation of the invention. The computing device 700 houses a motherboard 702. The motherboard 702 may include a number of components, including but not limited to a processor 704 and at least one communication chip 706. The processor 704 is physically and electrically coupled to the motherboard 702. In some implementations the at least one communication chip 706 is also physically and electrically coupled to the motherboard 702. In further implementations, the communication chip 706 is part of the processor 704.

Depending on its applications, computing device 700 may include other components that may or may not be physically and electrically coupled to the board 702. These other components include, but are not limited to, volatile memory (e.g., DRAM), non-volatile memory (e.g., ROM), flash memory, a graphics CPU or processor, a chipset, an antenna, a touchscreen display, a touchscreen controller, a battery, an audio codec, a video codec, a power amplifier (AMP), a global positioning system (GPS) device, a compass, a speaker, and a camera.

The communication chip 706 enables wireless communications for the transfer of data to and from the computing device 700. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 706 may implement any of a number of wireless standards or protocols, including but not limited to the IEEE 802.11 family, the IEEE 802.16 family, IEEE 802.20, and other wireless standards, as well as any other wireless protocols that are designated as 3G, 4G, 5G, and beyond. The computing device 700 may include a plurality of communication chips 706. For instance, a first communication chip 706 may be dedicated to shorter range wireless communications and a second communication chip 706 may be dedicated to longer range wireless communications.

The processor 704 of the computing device 700 includes an integrated circuit die packaged within the processor 704. In some implementations of the invention, the integrated circuit die of the processor may be packaged on an organic substrate and provide signals that are propagated along a dispersion reduced dielectric waveguide, in accordance with implementations of the invention. The term "processor" may refer to any device or portion of a device that processes electronic data from registers and/or memory to transform that electronic data into other electronic data that may be stored in registers and/or memory.

The communication chip 706 also includes an integrated circuit die packaged within the communication chip 706. In accordance with another implementation of the invention, the integrated circuit die of the communication chip may be packaged on an organic substrate and provide signals that are propagated along a dispersion reduced dielectric waveguide, in accordance with implementations of the invention.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize.

These modifications may be made to the invention in light of the above detailed description. The terms used in the following claims should not be construed to limit the invention to the specific implementations disclosed in the specification and the claims. Rather, the scope of the invention is to be determined entirely by the following claims, which are to be construed in accordance with established doctrines of claim interpretation.

Example 1: a dispersion reduced dielectric waveguide, comprising: a first dielectric material, wherein the first dielectric material has a first Dk-value; a second dielectric material, wherein the second dielectric material has a second Dk-value that is greater than the first Dk-value; and a conductive coating formed around the perimeter of the first dielectric material.

Example 2: the dispersion reduced dielectric waveguide of Example 1, wherein the second dielectric material is formed between portions of the first dielectric material.

Example 3: the dispersion reduced dielectric waveguide of Example 1 or Example 2, wherein the second dielectric material is substantially centered within the dispersion reduced dielectric waveguide.

Example 4: the dispersion reduced dielectric waveguide of Example 1, Example 2, or Example 3, wherein the conductive coating contacts the first dielectric material and the second dielectric material.

Example 5: the dispersion reduced dielectric waveguide of Example 1, wherein a perimeter of the second dielectric material is completely surrounded by the first dielectric material.

Example 6: the dispersion reduced dielectric waveguide of Example 5, wherein a shape of a perimeter of the first dielectric material is substantially similar to a shape of a perimeter of the second dielectric material.

Example 7: the dispersion reduced dielectric waveguide of Example 5, wherein a shape of a perimeter of the first dielectric material is different than a shape of a perimeter of the second dielectric material.

Example 8: the dispersion reduced dielectric waveguide of Example 5, Example 6, or Example 7, wherein a shape of a perimeter of the first dielectric material is substantially rectangular.

Example 9: the dispersion reduced dielectric waveguide of Example 5, Example 6, or Example 7, wherein a shape of a perimeter of the first dielectric material is substantially circular.

Example 10: the dispersion reduced dielectric waveguide of Example 1, Example 2, Example 3, Example 4, Example 5, Example 6, Example 7, Example 8, or Example 9, further comprising a plurality of dielectric materials, wherein the plurality of dielectric materials include dielectric materials with Dk-values between the first Dk-value and the second Dk-value.

Example 11: the dispersion reduced dielectric waveguide of Example 10, wherein the plurality of dielectric materials form a positive gradient between the first Dk-value and the second Dk-value.

Example 12: the dispersion reduced dielectric waveguide of Example 11, wherein the gradient is a substantially linear gradient.

Example 13: the dispersion reduced dielectric waveguide of Example 11, wherein the gradient is a non-linear gradient.

Example 14: the dispersion reduced dielectric waveguide of Example 1, wherein the second dielectric material is formed in a plurality of dielectric cores formed within the first dielectric material.

Example 15: the dispersion reduced dielectric waveguide of Example 14, wherein the plurality of cores are formed around the edges of the first dielectric material.

Example 16: a dispersion reduced dielectric waveguide, comprising: a first dielectric material, wherein the first dielectric material produces a first dispersion response when a signal is propagated along the first dielectric material; and a dispersion compensating material, wherein the dispersion compensating material produces a second dispersion response that is substantially opposite to the first dispersion response when the signal is propagated along the dispersion compensating material.

Example 17: the dispersion reduced dielectric waveguide of Example 16, wherein the dispersion compensating material is a metamaterial.

Example 18: the dispersion reduced dielectric waveguide of Example 17, wherein the metamaterial includes a plurality of rods, omega cell resonators, or split-ring resonators.

Example 19: the dispersion reduced dielectric waveguide of Example 17 or Example 18, wherein the dispersion compensating material is formed around the first dielectric layer.

Example 20: the dispersion reduced dielectric waveguide of Example 17 or Example 18, wherein the dispersion compensating material is formed between sections of the first dielectric material.

Example 21: the dispersion reduced dielectric waveguide of Example 20, wherein the dispersion compensating material is embedded within a second dielectric material.

Example 22: the dispersion reduced dielectric waveguide of Example 21, wherein the second dielectric material is a different dielectric material than the first dielectric material.

Example 23: a dispersion reduced dielectric waveguide, comprising: a first dielectric material, wherein the first dielectric material has a first Dk-value; a second dielectric material, wherein the second dielectric material has a second Dk-value that is greater than the first Dk-value; and a conductive layer formed around the first and second dielectric materials, wherein a first portion of a bandwidth of a signal that is propagated along the dispersion reduced dielectric waveguide is primarily propagated along the first dielectric material, and wherein a second portion of a bandwidth of the signal that is propagated along the dispersion reduced dielectric waveguide is primarily propagated along the second dielectric material.

Example 24: the dispersion reduced dielectric waveguide of Example 23, wherein a wherein a frequency of operation of the dielectric waveguide is between 90 GHz and 140 GHz.

Example 25: the dispersion reduced dielectric waveguide of Example 24, wherein the bandwidth of the signal that is propagated along the dispersion reduced dielectric waveguide is approximately 50 GHz or greater.

What is claimed is:

1. A dispersion reduced dielectric waveguide, comprising:

a first dielectric material, wherein the first dielectric material has a first Dk-value, and wherein the first dielectric material has a top surface, a bottom surface, and side surfaces;

a second dielectric material, wherein the second dielectric material has a second Dk-value that is greater than the first Dk-value;

a third dielectric material, wherein the third dielectric material has a third Dk-value that is different from the first Dk-value and different from the second Dk-value; and a conductive coating on the top surface, on the bottom surface, and on the side surfaces of the first dielectric material, wherein the conductive coating contacts the first dielectric material and the second dielectric material.

2. The dispersion reduced dielectric waveguide of claim 1, wherein the second dielectric material is between portions of the first dielectric material.

3. The dispersion reduced dielectric waveguide of claim 2, wherein the second dielectric material is substantially centered within the dispersion reduced dielectric waveguide.

4. The dispersion reduced dielectric waveguide of claim 1, further comprising a fourth dielectric material in addition to the first dielectric material, the second dielectric material and the third dielectric material, wherein the fourth dielectric material has a Dk-value between the first Dk-value and the second Dk-value.

5. A dispersion reduced dielectric waveguide, comprising:

a first dielectric material, wherein the first dielectric material produces a first dispersion response when a signal is propagated along the first dielectric material; and a dispersion compensating material, wherein the dispersion compensating material produces a second dispersion response that is substantially opposite to the first dispersion response when the signal is propagated along the dispersion compensating material.

6. The dispersion reduced dielectric waveguide of claim 5, wherein the dispersion compensating material is a metamaterial.

7. The dispersion reduced dielectric waveguide of claim 6, wherein the dispersion compensating material surrounds the first dielectric material.

8. The dispersion reduced dielectric waveguide of claim 6, wherein the dispersion compensating material is formed between sections of the first dielectric material.

9. The dispersion reduced dielectric waveguide of claim 8, wherein the dispersion compensating material is embedded within a second dielectric material.

10. The dispersion reduced dielectric waveguide of claim 9, wherein the second dielectric material is a different dielectric material than the first dielectric material.

11. A dispersion reduced dielectric waveguide, comprising:

a first dielectric material, wherein the first dielectric material has a first Dk-value;

a second dielectric material, wherein the second dielectric material has a second Dk-value that is greater than the first Dk-value; and a conductive layer formed around the first and second dielectric materials, wherein the conductive layer contacts the first dielectric material and the second dielectric material, wherein a first portion of a bandwidth of a signal that is propagated along the dispersion reduced dielectric waveguide is primarily propagated along the first dielectric material, and wherein a second portion of the bandwidth of the signal that is propagated along the dispersion reduced dielectric waveguide is primarily propagated along the second dielectric material.

12. The dispersion reduced dielectric waveguide of claim 11, wherein the first portion of the bandwidth and the second portion of the bandwidth are between 90 GHz and 140 GHz.

* * * * *